US011753899B2

(12) United States Patent
Manett et al.

(10) Patent No.: US 11,753,899 B2
(45) Date of Patent: Sep. 12, 2023

(54) CONTROL SYSTEM FOR A WELL CONTROL DEVICE

(71) Applicant: Expro North Sea Limited, Aberdeen (GB)

(72) Inventors: Kris Manett, Fraserburgh (GB); Jamie Drummond Walker, Kintore (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 17/827,233

(22) Filed: May 27, 2022

(65) Prior Publication Data

US 2022/0381111 A1 Dec. 1, 2022

(30) Foreign Application Priority Data

May 28, 2021 (GB) ..... 2107620

(51) Int. Cl.
*E21B 34/04* (2006.01)
*E21B 17/01* (2006.01)

(52) U.S. Cl.
CPC ..... *E21B 34/04* (2013.01); *E21B 17/01* (2013.01)

(58) Field of Classification Search
CPC ..... E21B 33/0355; E21B 34/04; E21B 34/045
See application file for complete search history.

(56) References Cited

U.S. PATENT DOCUMENTS

| | | | | |
|---|---|---|---|---|
| 8,347,967 | B2 * | 1/2013 | Mathis | E21B 33/0355 166/368 |
| 8,725,302 | B2 * | 5/2014 | Niemeyer | E21B 33/0355 700/282 |
| 9,091,136 | B2 * | 7/2015 | Allensworth | E21B 29/12 |
| 10,655,418 | B2 * | 5/2020 | Rytlewski | E21B 41/04 |
| 2018/0187506 | A1 * | 7/2018 | Bhadbhade | E21B 47/02 |
| 2019/0368297 | A1 * | 12/2019 | Abusomwan | E21B 34/14 |

FOREIGN PATENT DOCUMENTS

| | | | | |
|---|---|---|---|---|
| WO | WO-2014116577 | A1 * | 7/2014 | E21B 33/063 |

* cited by examiner

*Primary Examiner* — Matthew R Buck
(74) *Attorney, Agent, or Firm* — Getz Balich LLC

(57) ABSTRACT

A control system automatically operates a subsea well control device on detecting that a load in an Intervention Riser System (IRS) coupled to the subsea well control device has reached a threshold. The control system has a first control unit to detect that the load in the IRS has reached the threshold and a second control unit triggering actuation of the subsea well control device. The first control unit is in communication with the second control unit and issues an activation command to the second control unit to cause it to trigger actuation of the subsea well control device. The first control unit automatically issues the activation command to the second control unit upon detecting that the load in the IRS has reached the threshold, to trigger actuation of the subsea well control device prior to structural failure of an IRS.

13 Claims, 4 Drawing Sheets

CONTROL SYSTEM FOR A WELL CONTROL DEVICE

This application claims priority to GB Patent Appln. No. 2107620.3 filed May 28, 2021, which is hereby incorporated herein by reference in its entirety.

BACKGROUND OF THE INVENTION

1. Technical Field

The present disclosure relates to a control system for operating a subsea well control device, a well control arrangement comprising a subsea well control device and a control system for automatically operating the well control device for an Intervention Riser System (IRS), and a method of operating a well control assembly. In particular, but not exclusively, the present disclosure relates to a control system for operating a well control device in a subsea well involving, and an associated well control arrangement and method.

2. Background Information

In the oil and gas exploration and production industry, a well control device in the form of a blow-out preventer (BOP) is utilized to contain wellbore fluids during well drilling, completion, and testing operations. The BOP can be operated to contain wellbore fluids in an annular space between wellbore tubing (casing) and smaller diameter tubing disposed within the casing, as well as in an 'open hole'. The BOP comprises a shear mechanism having an arrangement of shear rams, and seal rams which can seal around media extending through the BOP. The BOP provides ultimate pressure control of the well. In an emergency situation, the shear rams can be activated to sever any media extending through the BOP and shut-in the well.

The use of through-BOP intervention riser systems (TBIRS) are known in the industry. A TBIRS is used for through-riser deployment of equipment, such as completion architecture, well testing equipment, intervention tooling and the like into a subsea well from a surface vessel. When in a deployed configuration, a landing string of the TBIRS extends between the surface vessel and a wellhead, in particular, a subsea BOP on the wellhead. The TBIRS is run inside of a marine riser and subsea BOP system, and incorporates well control features in addition to those on the subsea BOP, typically a dedicated suite of valves.

While deployed the TBIRS provides many functions, including permitting the safe deployment of wireline or coiled tubing equipment through the landing string and into the well, providing well control barriers (independent of the BOP), and permitting a sequenced series of device actions intended to achieve a safe-state in relation to a specific hazardous event such as emergency shut down (ESD) and emergency quick disconnect (EQD), while isolating both the well and a surface vessel from which the TBIRS is deployed.

Well control and isolation in the event of an emergency is provided by a suite of valves located at a lower end of the TBIRS, positioned inside a central bore of the Subsea BOP. The valve suite can include a subsea test tree (SSTT) or other well barrier/control device, which provides a well barrier to contain well pressure, and a retainer valve which isolates the landing string contents and can be used to vent trapped pressure from between the retainer valve and the SSTT (or other barrier device) prior to disconnection. A shear sub component extends between the retainer valve and the SSTT, which is capable of being sheared by the Subsea BOP if required. The TBIRS requires to be capable of cutting any wireline or coiled tubing which extends therethrough in a specific hazardous event such as emergency shut down (ESD) and emergency quick disconnect (EQD), and providing a seal afterwards.

It is known in the art to use one or more valves of an SSTT to shear the wireline or coiled tubing upon closure, and provide a well barrier seal against the well flow. During operation of the Subsea BOP, one or more shear rams may be required to shear the TBIRS shear sub (including any wireline or coiled tubing deployed through the TBIRS) upon closure and provide a well barrier seal against well flow.

The tubing/landing string may form part of the well control arrangement. The tubing/landing string may be adapted to be deployed subsea through a riser, which riser may be connected to a wellhead, optionally to a BOP. The well control device may be connected to the tubing, and may be adapted to be positioned within the BOP. The well control arrangement may take the form of a through-BOP intervention riser system (TBIRS) comprising the well control device, and optionally the tubing/landing string.

The present invention, in addition to TBIRS arrangements is applicable to Open-Water intervention riser systems (OWIRS). OWIRS provide a conduit between the subsea well and the surface vessel that can be used for the installation and retrieval of subsea trees, well intervention, well tests, and flowbacks. It is noteworthy that the OWIRS is run independently of the marine drilling riser and subsea BOP systems and incorporates its own well control features. Whilst the invention will primarily be described and explained in relation to TBIRS it will be appreciated that the invention is applicable also to OWIRS.

Subsea wells are often accessed via a floating surface facility, such as a vessel or a rig. The TBIRS is suspended from the surface facility with the SSTT located in the BOP. The self-weight of the TBIRS including the landing string is significant. As is well-known therefore, tension is applied to the TBIRS at the surface facility, in order to limit the loading applied to the landing string and so prevent its structural failure. This is achieved using tensioning equipment coupled to a derrick on the surface facility.

The surface facility is subject to external loading under the prevailing sea conditions, and so moves relative to the wellhead as the facility heaves, pitches and rolls. It is important that this movement of the facility is considered, in order to ensure that a correct level of tension is applied to the TBIRS. This maybe achieved using a dynamic device known as a heave compensator or other device, which allows for a relative movement between the facility and the TBIRS (suspended from the derrick) as the facility moves under the prevailing sea conditions, particularly heave motion in which a vertical displacement of the facility relative to the seabed (and so the wellhead) occurs. The compensator or other device maintains a desired level of tension in the landing string, to ensure against structural failure of the string, which could occur if too high a loading (tensile or compressive) is experienced.

A problem can therefore occur in the event that the heave compensator or other device fails (e.g. if it locks), resulting in an undesirable over-tension or compression of the TBIRS, as the facility moves under the prevailing sea conditions. This could cause a structural failure of a component within the TBIRS leading to it rupturing, with consequential loss of control of the well. In particular, rupture of the TBIRS can lead to control equipment (such as hydraulic control lines) coupled to the SSTTA being sheared or otherwise damaged. Although SSTT valves are arranged to fail-close, for example under the biasing action of a spring, this can have the result that the SSTT valves cannot be actuated, if coiled tubing or other media is located in the SSTT bore when the rupture occurs.

Other problems can lead to structural failure in the TBIRS (or tubing), including an operator accidentally applying greater tension to the TBIRS than is required when deploying or operating an SSTTA.

It is therefore desirable to provide a system which can actuate an SSTT (or any other suitable well control device) prior to a structural failure of a IRS (or other tubing occurring), to ensure closure of the SSTT or well control device. Failure of the IRS whether in TBIRS or OWIRS can occur through failure of equipment comprising the IRS such as tubing, valves, joints, connectors. Predictive modelling of the IRS can determine the likely mode and location of failure and the loading at which failure will be likely to occur.

SUMMARY OF THE INVENTION

According to a first aspect of the present disclosure, there is provided a control system for automatically operating a subsea well control device on detecting that a load in an IRS (including in individual components, equipment, assemblies or structures comprising the IRS) coupled to the well control device has reached a threshold, which threshold is below a failure load of the IRS (or individual components, equipment, assemblies or structures comprising the IRS), the control system comprising: a first control unit configured to detect that the load in the IRS has reached the threshold; and a second control unit adapted to be connected to the well control device, for triggering actuation of the well control device to cause it to move from a deactivated state to an activated state in which the well control device provides a well control function; in which the first control unit is connected to and/or in communication with the second control unit and configured to issue an activation command to the second control unit to cause it to trigger actuation of the well control device; and in which the first control unit is configured to automatically issue the activation command to the second control unit upon detecting that the load in the IRS has reached the threshold, to trigger actuation of the well control device prior to any structural failure of the IRS (or individual components, equipment, assemblies or structures comprising the IRS) occurring.

The control system of the present disclosure may provide the advantage that the system can automatically trigger actuation of the well control device, prior to a situation arising in which structural failure of the weak link in the IRS (or individual components, equipment, assemblies or structures comprising the IRS) could occur. This is because the well control device is triggered to actuate if the threshold load in the IRS is reached, the threshold being below a load which would lead to structural failure (the 'failure load'). The weak link location and failure load may be identified by prediction modelling, or may be engineered to be in a defined location and at a defined load. In this way, actuation of the well control device can be ensured, as actuation is effected prior to any control equipment coupled to the well control device being disconnected, for example if structural failure of the tubing, or other equipment or components subsequently occurs, severing hydraulic control lines coupled to the control device.

Structural failure of a component may be a failure in an integrity of the component, which may: affect its ability to sustain applied loading; affect its ability to contain internal pressure; and/or affect its ability to provide a fluid pathway (and so to contain fluids and/or resist fluid ingress).

The well control device may be located in a subsea blow-out preventer (BOP).

The control system may be for automatically operating the well control device on detecting a failure condition in a heave compensator or other device for the weak link in the IRS, which failure may lead to an increase in the load in the weak link approaching, or breaching, the failure load. For example, a failure condition leading to the heave compensator or other device locking or otherwise failing to operate correctly may have the result that the load in the weak link in the IRS increases, as a surface facility (e.g. a rig or vessel) from which the IRS is deployed moves under prevailing sea or weather conditions, in particular during heave motion of the facility.

The control system may be for automatically operating the well control device on detecting an overload in the tubing imparted by tensioning equipment coupled to the IRS. For example, an over-tension may be applied to the IRS leading to a load in the weak link component or assembly approaching the failure load. The over-tension may be above a planned or determined tensile load to be applied to the IRS. In use, the well control device may be latched or locked within the BOP at a fixed location, and so application of an over-tension may stress the IRS, potentially leading to structural failure.

The threshold may be a proportion of the failure load of the IRS. The threshold may be selected so that a safe operating margin is provided between the threshold being reached and the failure load being met or breached, so as to ensure actuation of the well control device. For example, the threshold may be a percentage of the failure load of the weak link in the IRS, and may be in the range of about 75% to about 95% of the failure load, although this may vary significantly depending on factors including dimensions of the IRS components (length, diameter and/or wall thickness), the self-weight of the landing string, IRS and/or well control device, and the tension to be applied. There may be different failure loads in tension and compression, and so a tensile failure load and a compressive failure load. There may therefore be different thresholds in tension and compression, and so a tensile threshold and a compressive threshold.

The first control unit may be a surface unit, and/or may be adapted to be provided at surface. Reference to the first control unit being a surface unit and/or being provided at surface should be taken to encompass the unit being provided on or at a rig or other surface facility (in the case of an offshore or subsea well), although it is conceivable that the unit could be provided on or at seabed level.

The second control unit may be adapted to be provided subsea. This may provide the advantage that the second control unit can rapidly actuate the well control device on receipt of the activation command.

The first control unit may be connected to the second control unit via at least one control line, which may be an electrical control line. The first well control unit may be adapted to be acoustically connected to the second well control unit. The first control unit may be configured to issue an electrical and/or acoustic activation command to the second control unit. This may provide the advantage that the activation command can be transmitted to the second control unit relatively rapidly, on detection of the load reaching the threshold (by the first control unit).

Issuance of an electrical and/or acoustic activation command may represent a relatively fast means of communication, which may in turn facilitate actuation of the well control device prior to a situation arising in which structural failure of the weak link identified in (or designed into) the IRS could occur. It is expected that a delay of no more than perhaps 5 seconds may be experienced between detection of the load reaching the threshold, and actuation of the well control device.

Other means of connecting the first control unit to the second control unit may be employed, including but not restricted to electromagnetic signaling equipment comprising a transmitter associated with the first control unit and a receiver associated with the second control unit, which may be adapted to transmit and receive radio frequency or acoustic (e.g. ultrasonic) frequency signals, respectively. The tubing, which may be coupled to the second control unit, may act as a signal transmission medium.

The first control unit may be configured to operate a reeling device to withdraw coiled tubing (or other media) extending through a bore of the well control device. The first control unit may be configured to trigger the reeling device to actuate when the following conditions are satisfied: i) the load in the IRS has reached the threshold; ii) coiled tubing (or other media) is located in the bore of the well control device; and iii) actuation of the well control device (triggered by the activation command issued to the second control unit) presents the risk of at least one function of the well control device being restricted. The function may be a sealing function of the well control device and/or closure of the device. The well control device may be or may comprise a valve assembly comprising: a cutting valve; a cutting valve and a sealing valve; and/or a combined cutting and sealing valve. The cutting valve may be provided below or downhole of the sealing valve (in normal use of the device). Operation of the cutting valve may therefore present a risk of the sealing valve (located above/uphole) being blocked by a portion of the severed coiled tubing or other media. The first control unit may therefore be configured to trigger the reeling device to actuate when the sealing valve is located above/uphole of the cutting valve, and condition iii) involves a risk of the sealing valve being blocked by a severed portion of the coiled tubing or other media. The first control unit may comprise a processor configured to trigger the reeling device to actuate when conditions i) to iii) are satisfied.

The second control unit may comprise a source of energy for actuating the well control device. The source of energy may be selected from the group comprising: a source of hydraulic energy; a source of electrical energy; and a combination of the two. The source of hydraulic energy may comprise a volume of pressurized fluid, and may be or comprise a hydraulic accumulator (in particular a subsea accumulator). The source of hydraulic energy may be charged with pressurized hydraulic fluid prior to deployment (e.g. to a subsea location), and/or may be connected to surface via at least one hydraulic line. The source of electrical energy may be or may comprise a battery, and/or an electrical power conduit extending to surface.

The second control unit may comprise at least one valve for controlling the flow of hydraulic fluid from the source of hydraulic energy to the well control device. The at least one valve may be triggered to move from a closed position to an open position when the activation command is received by the second control unit. At least one valve may be electrically or electronically actuated, and may be a solenoid operated valve (SOV) and/or a directional control valve (DCV).

The second control unit may comprise a flow monitoring device, which may be adapted to be coupled to the well control device. Where the well control device is or comprises a valve assembly, the flow monitoring device may be adapted to be coupled to at least one valve of the valve assembly, and may serve for monitoring the flow of fluid from the valve and determining a corresponding actuation state of the valve. The flow monitoring device may serve for monitoring flow of fluid from the valve during movement of the valve from an open to a closed position. The flow monitoring device may be capable of determining an actuation state of the valve by measuring a volume of fluid exiting the valve. Actuation of the valve to a fully closed state may require that a determined volume of fluid exit the valve (for example a hydraulic chamber of the valve). The flow monitoring device may determine that the valve has been fully closed when the determined volume of fluid is detected as having exited the valve. Where the valve assembly comprises a cutting valve, such monitoring of the valve position may enable a determination to be made as to whether the cutting valve has severed coiled tubing (or other media) extending through a bore of the well control device.

The second control unit may be configured to transmit information relating to the operation state of the valve, determined using the flow monitoring device, to the first control unit. The first control unit may be configured to employ the information to determine whether to actuate the reeling device. The first control unit may be configured to trigger the reeling device to actuate only when a further condition, which may be a condition iv), is satisfied, in which the valve is detected as having moved to its fully closed position. Where the valve is a cutting valve, this may ensure that the reeling device is not operated until such time as a determination has been made that the coiled tubing (or other media) extending through the bore of the well control device has been severed or cut.

The second control unit may be provided as part of, or may form, a riser control module (RCM). The RCM may be adapted to be coupled to the well control device and may be provided on or in a landing string coupled to the well control device, which landing string may form part of a through-BOP intervention riser system (TBIRS), for deploying the device into the well.

According to a second aspect of the present disclosure, there is provided a well control arrangement comprising a subsea well control device and a control system for automatically operating the well control device on detecting that a load in the system coupled to the well control device has reached a threshold, which threshold is below a failure load of the weak link in the IRS, the control system comprising: a first control unit configured to detect that the load in the IRS has reached the threshold; and a second control unit connected to the well control device, for triggering actuation of the well control device to cause it to move from a deactivated state to an activated state in which the well control device provides a well control function; in which the first control unit is connected to and/or in communication with the second control unit and configured to issue an activation command to the second control unit to cause it to trigger actuation of the well control device; and in which the first control unit is configured to automatically issue the activation command to the second control unit on detecting that the load in the IRS has reached the threshold, to trigger actuation of the well control device prior to any structural failure of equipment comprising the IRS occurring.

As for the first aspect described, the reference to the IRS and the 'weak link' should be taken to include the components, assemblies, and all other equipment comprising the IRS, including but not limited to valves, joints, tubing, connectors etc.

According to a third aspect of the present disclosure, there is provided a well control assembly for a subsea well, comprising: a IRS comprising a subsea well control device and a string of tubing coupled to the well control device, for deploying the well control device from a surface facility to a subsea location; a tensioning device, for controlling an amount of tension applied to the IRS; and a control system for automatically operating the well control device on detecting that a load in the IRS equipment coupled to the well control device has reached a threshold, which threshold is below a failure load of a predicted or pre-identified component or weak link in the IRS, the control system comprising: a first control unit configured to detect that the load in the IRS has reached the threshold; and a second control unit connected to the well control device, for triggering actuation of the well control device to cause it to move from a deactivated state to an activated state in which the well control device provides a well control function; in which the first control unit is connected to and/or in communication with the second control unit and configured to issue an activation command to the second control unit to cause it to trigger actuation of the well control device; and in which the first control unit is configured to automatically issue the activation command to the second control unit on detecting that the load in the IRS has reached the threshold, to trigger actuation of the well control device prior to any structural failure of IRS equipment occurring.

As for the first and second aspects described above, the reference to the IRS and the 'weak link' should be taken to include the components, assemblies, and all other equipment comprising the IRS, including but not limited to valves, joints, tubing, connectors etc.

A string of tubing comprising the IRS may comprise lengths of tubing coupled together end-to-end, to form a string of desired length. The well control assembly may take the form of a through-BOP intervention riser system (TBIRS) comprising the landing string and the well control device. The well control assembly may take the form of an open-water intervention riser system.

The tensioning device may be or may comprise a heave compensator or other device, for compensating movement of the surface facility relative to the subsea location. The heave compensator or other device may control the amount of tension applied to the IRS by permitting relative movement between the tubing and the surface facility, for example due to external loading on the surface facility such as under prevailing weather conditions. The heave compensator or other device may be an active heave compensator or other device. The tensioning device may be or may comprise a support for the tubing, which support may be capable of varying an amount of tension applied to the IRS.

Optional further features of the well control arrangement of the second aspect and/or the well control assembly of the third aspect may be derived from the text set out elsewhere in this document, particularly in or with reference to the first aspect described above.

According to a fourth aspect of the present disclosure, there is provided a method of operating a well control assembly comprising a subsea well control device, the method comprising the steps of: providing a first control unit which is configured to detect a load in IRS equipment coupled to the well control device; providing a second control unit, and connecting the second control unit to the well control device, actuation of the well control device being controlled by the second control unit; connecting (and/or enabling communication between) the first control unit to the second control unit; and configuring the first control unit to automatically issue an activation command to the second control unit, when the first control unit detects that the load in the IRS equipment has reached a threshold which is below a failure load of a preidentified or predicted weak link in the IRS, to cause the second control unit to trigger actuation of the well control device to move from a deactivated state to an activated state in which the well control device provides a well control function, so that the well control device is actuated prior to any structural failure of IRS equipment occurring.

The method may comprise arranging the first control unit to automatically issue the activation command, to trigger actuation of the well control device, on detecting a failure condition in a heave compensator or other device comprising the IRS. The failure condition may lead to an increase in the load in for example the tubing of the IRS approaching, or breaching, a failure load.

The method may comprise arranging the first control unit to automatically issue the activation command, to trigger actuation of the well control device, on detecting an overload in the weak link in the IRS imparted by tensioning equipment coupled to the IRS.

The method may comprise providing the first control unit at surface. The method may comprise providing the second control unit at a subsea location. The method may comprise connecting the first control unit to the second control unit via at least one control line, which may be an electrical control line. The method may comprise arranging the first control unit to issue an electrical activation command to the second control unit. Other means of connecting the first control unit to the second control unit may be employed, including but not restricted to electromagnetic signaling equipment comprising a transmitter associated with the first control unit and a receiver associated with the second control unit, which may be adapted to transmit and receive radio frequency or acoustic (e.g. ultrasonic) frequency signals, respectively. The tubing coupled to the second control unit may act as a signal transmission medium.

The method may comprise selectively operating a reeling device to withdraw coiled tubing (or other media) extending through a bore of the well control device. The method may comprise arranging the first control unit to selectively operate the reeling device. The method may comprise arranging the first control unit to trigger the reeling device to actuate when the following conditions are satisfied: i) the load in the IRS has reached the threshold; ii) coiled tubing (or other media) is located in the bore of the well control device; and iii) actuation of the well control device (triggered by the activation command issued to the second control unit) presents the risk of at least one function of the well control device being restricted. The function may be closure of a valve of the well control device.

The method may comprise providing the second control unit with a source of energy for actuating the well control device. The source of energy may be selected from the group comprising: a source of hydraulic energy; a source of electrical energy; and a combination of the two.

The method may comprise triggering at least one valve of the second control unit to move from a closed position to an open position when the activation command is received by the second control unit, to permit the flow of hydraulic fluid to the well control device, to actuate the device. The method may comprise monitoring a return flow of fluid from the control device valve and determining a corresponding actuation state of the control device valve employing return flow volume measurements. The flow monitoring device may be capable of determining an actuation state of the cutting valve by measuring the volume of fluid exiting the control device valve.

The method may comprise arranging the second control unit to transmit information relating to the operation state of the well control device valve to the first control unit. The method may comprise arranging the first control unit to employ the information to determine whether to actuate the reeling device. The first control unit may trigger the reeling device to actuate only when a further condition, which may be a condition iv), is satisfied, in which the valve is detected as having moved to its fully closed position.

Optional further features of the method may be derived from the text set out elsewhere in this document, particularly in or with reference to the first, second and/or third aspects described above.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
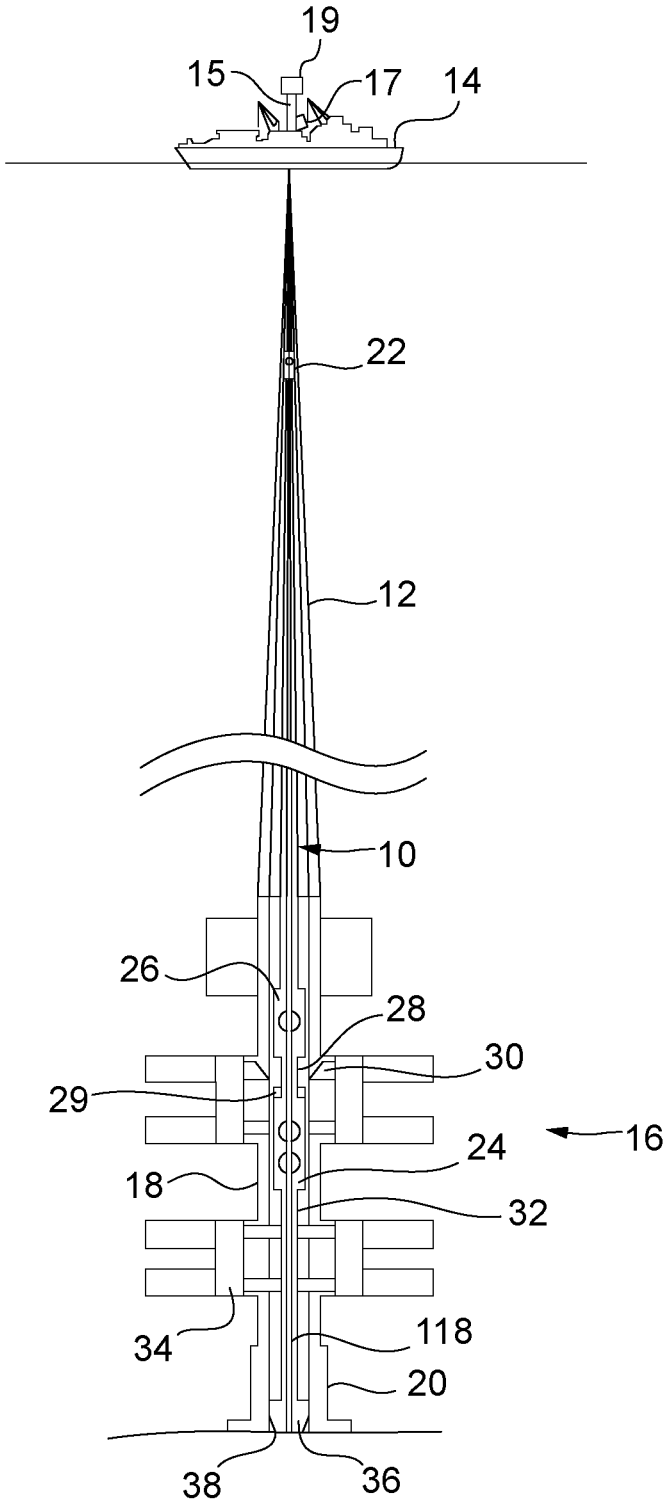
FIG. 1 is a schematic side view of a through-BOP intervention riser system (TBIRS) of a conventional type, incorporating a well control device in the form of a subsea test tree (SSTT) located in a subsea BOP.

Turning firstly to FIG. 1, there is shown a schematic view of a through-BOP intervention riser system (TBIRS) 10, shown in use during an exploration and appraisal (E & A) procedure. The TBIRS 10 is located within a marine riser 12 and extends between a surface facility in the form of a vessel 14, and a subsea BOP 18 which is mounted on a wellhead (not shown). The use and functionality of a TBIRS is well known in the industry for through-riser deployment of equipment, such as completion architecture, well testing equipment, intervention tools and the like, into a subsea well from a surface vessel. In this regard, it will be noted that through-BOP intervention riser systems have previously been referred to in the industry more generally as landing strings.

When in a deployed configuration the TBIRS 10 extends through the marine riser 12 and into the BOP 18. While deployed the TBIRS 10 provides many functions, including permitting the safe deployment of wireline or coiled tubing equipment (coiled tubing being shown at 118 in the drawing) through the TBIRS and into the well, providing the necessary well control barriers and permitting emergency disconnect while isolating both the well and TBIRS 10. Wireline or coiled tubing deployment may be facilitated via a lubricator valve 22 which is located proximate the surface vessel 14.

Well control and isolation in the event of an emergency disconnect is provided by a suite of valves, which are located at a lower end of the TBIRS 10 inside the BOP, and carried by a landing string 20 of the TBIRS. The valve suite includes a well control or barrier device in the form of a subsea test tree (SSTT) 24, which forms part of the TBIRS 10, and which provides a safety barrier to contain well pressure, and functions to cut any coiled tubing, wireline or other media which extends through a bore of the SSTT. The valve suite can also include an upper valve assembly, typically referred to as a retainer valve (RV) 26, which isolates the landing string contents and which can be used to vent trapped pressure from between the RV 26 and the SSTT 24. A shear sub component 28 extends between the RV 26 and SSTT 24, which is capable of being sheared by shear rams 30 of the BOP 18 if required. A latch 29 connects the landing string 20 to the SSTT 24 at the shear sub 28. A slick joint 32 extends below the SSTT 24, and facilitates engagement with BOP pipe rams 34.

In the E & A procedure shown in FIG. 1, the TBIRS 10 includes a fluted hanger 36 at its lowermost end, which engages with a wear bushing 38. When the TBIRS 10 is fully deployed and the corresponding hanger 36 and bushing 38 are engaged, the weight of the lower string (such as a completion, workover string or the like which extends into the well and thus is not illustrated) becomes supported through the wellhead.

Figure 2:
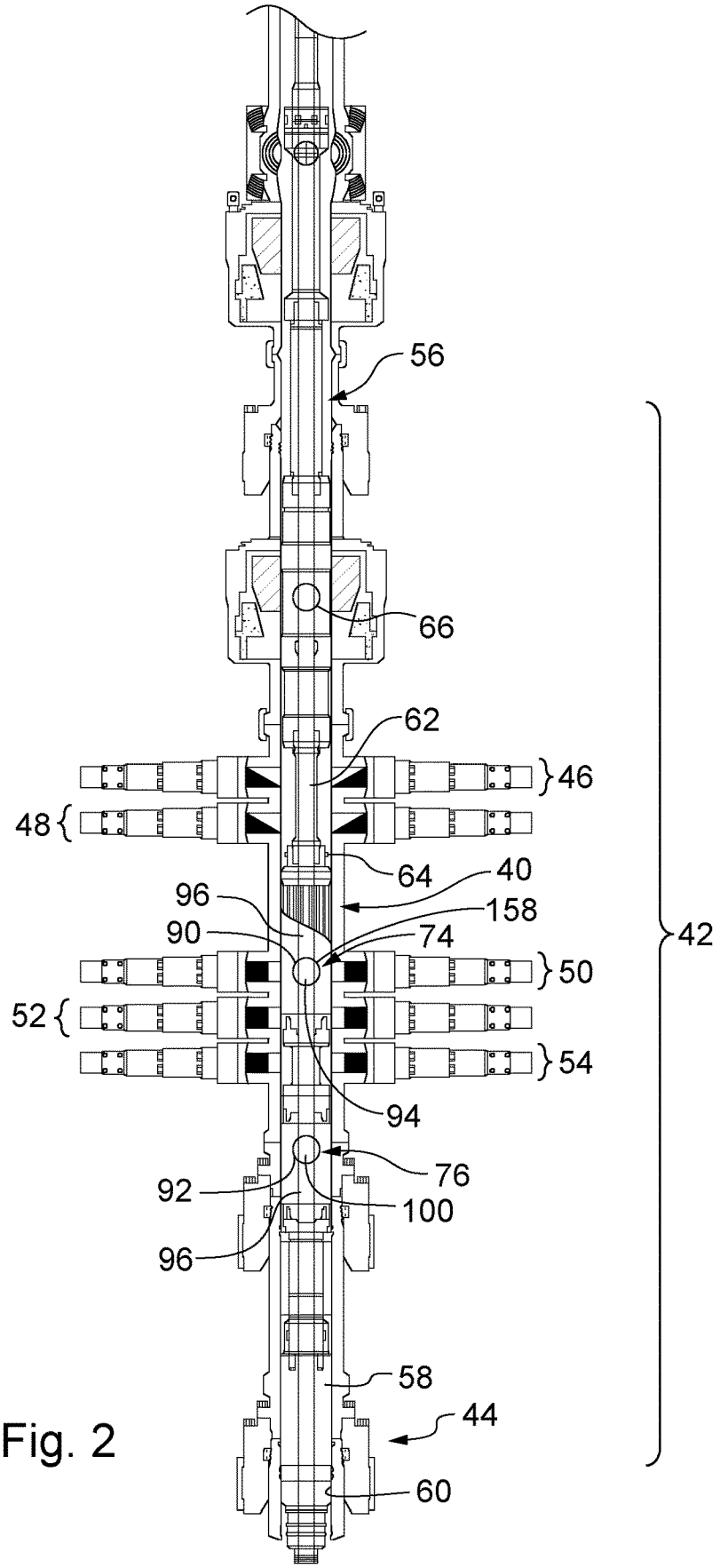
FIG. 2 is a schematic side view of a TBIRS well control device in the form of an SSTT, comprising a control system according to an embodiment of the present disclosure, the SSTT located in a subsea BOP, the SSTT and BOP shown in deactivated states.

Turning now to FIG. 2, there is shown a schematic side view of an SSTT according to an embodiment of the present disclosure, indicated generally by reference numeral 40 and illustrated in greater detail than the SSTT 24 in FIG. 1. The SSTT 40 is located in a subsea BOP 42 that is mounted on a wellhead 44. The BOP 42 is shown in FIG. 2 with a shear mechanism in a deactivated state. A typical intervention procedure may involve running a downhole tool or other component through the TBRIS 10 (including an RV 66 and SSTT 40) and into the well on coiled tubing, wireline or slickline (such as the coiled tubing 118 shown in FIG. 1), as is well known in the field of the invention. The BOP 42 shown in the drawing includes two sets of shear rams 46 and 48, and three sets of pipe (seal) rams 50, 52 and 54.

In common with the SSTT 24 shown in FIG. 1, the SSTT 40 is run into the subsea BOP 42 on a landing string 20, and is locked in the wellhead 44 by a tubing hanger 58. The SSTT 40 is connected to a shear sub 62 via a latch 64. The latch 64 can be activated to release the landing string 20 for recovery to surface, say in the event of an EQD being carried out, leaving the SSTT 40 in place within the subsea BOP 42. The RV 66 is provided above the shear sub 62, and is connected to the landing string 20 via a spacer sub 56 and an annular slick joint 57.

Figure 3:
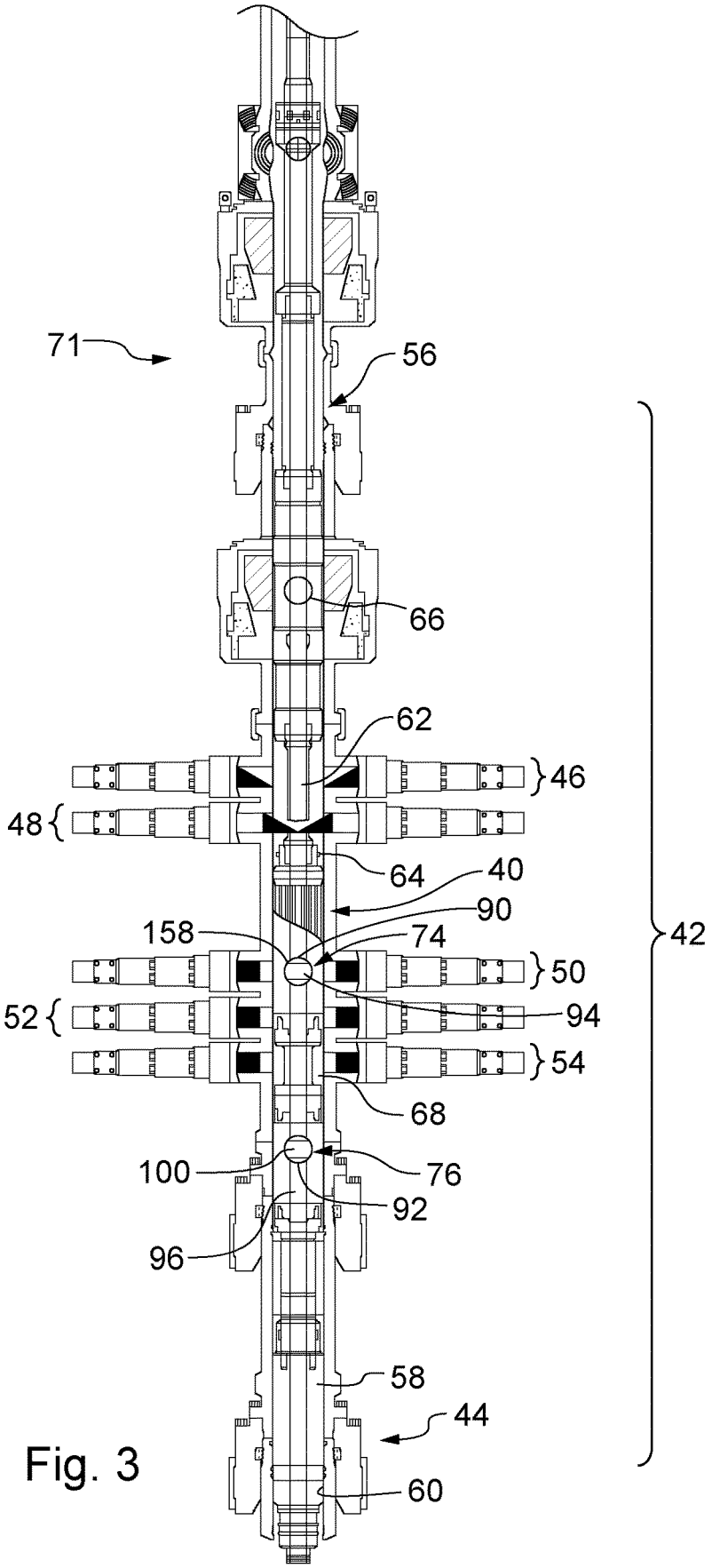
FIG. 3 is a view of the SSTT of FIG. 2, showing the BOP and the SSTT in activated states.

In the event of an emergency situation arising, the subsea BOP shear rams 46 and/or 48 can be operated to sever the shear sub 62. This is shown in FIG. 3, which is a view similar to FIG. 2, but which shows the subsea BOP 42 following operation of the lower shear rams 48. The pipe rams 54 would also be activated, sealing the annulus 68 between an external surface of an integral slick joint of the SSTT 40 and an internal wall of the BOP 42. The well has then been contained and the severed landing string 20 can be recovered to surface and a lower marine riser package (LMRP) 71 coupled to the subsea BOP 42 disconnected if required.

The TBIRS including the SSTT assembly 40 or well control device is suspended from the vessel 14, suitably from a derrick which is indicated generally by reference numeral 15 in FIG. 1. A tensioning device in the form of a heave compensator or other device is also provided on the vessel 14, and is indicated generally by reference numeral 17 in the drawing. As is well known in the industry, the heave compensator 17 allows for a relative movement between the vessel 14 and the TBIRS (suspended from the derrick 15) as the vessel moves under the prevailing sea conditions, particularly heave motion in which a vertical displacement of the vessel relative to a wellhead (not shown in FIG. 1) on the seabed occurs. The compensator 17 maintains a desired level of tension in the system, to ensure against structural failure, which could occur if too high a loading (tensile or compressive) is experienced by a weak link in the TBIRS which could be the tubing or another component, assembly or system making up the TBIRS. The location of, and failure load for, the weak link in the TBIRS could be identified or predicted by modelling. Alternatively, the failure threshold could be estimated conservatively. Alternatively. a weak link could be engineered into the TBIRS to give a known likely failure location at a known load.

The SSTT 40 generally comprises upper and lower valves 74 and 76, which have at least one of a cutting function and a sealing function. In the illustrated embodiment, the upper valve 74 has a sealing function, whilst the lower valve 76 has a cutting function. A suitable cutting valve is disclosed in the applicant's International patent application no. PCT/GB2015/053855 (WO-2016/113525), the disclosure of which is incorporated herein by this reference. In variations, one or both of the SSTT valves 74 and 76 can have both a cutting and a sealing function; the valve functions may be reversed; or a single shear and seal type valve may be used. The SSTT valves 74 and 76 are each moveable between an open position, which is shown in FIG. 2, and a closed position, which is shown in FIG. 3. Movement of the SSTT valves 74 and 76 between their open and closed positions is controlled via hydraulic fluid supplied to the valves through control lines, as will be described in more detail below.

As explained above, problems can occur for example in the event that the compensator 17 fails or an over-tension is applied to the landing string 56, and can lead to structural failure of the weak link in the TBIRS. In that event, the control lines coupled to the SSTT 40 are severed, with the result that the SSTT valves 74 and 76 can no longer be hydraulically actuated to move to their closed positions. The valves 74 and 76 are biased towards their closed positions by springs or other suitable biasing elements, so that the valves 'fail-close'. However, the 'fail-close' method may not provide sufficient force to close the valves in the event that the coiled tubing 118 (or other media) remains in the SSTT assembly 40. Well control can then only be achieved using the BOP 42, by operating its shear and pipe rams 46, 48 and 50 to 54.

To ensure actuation of the SSTT 40 prior to any such structural failure occurring, a control system is provided, for automatically operating the SSTT or other well control device. This is illustrated in the high level schematic illustration of FIG. 4, in which the control system is indicated generally by reference numeral 86. The control system 86, together with the SSTT 40, form a well control arrangement. The compensator 17 can be considered to form part of a well control assembly comprising the well control arrangement.

Figure 4:
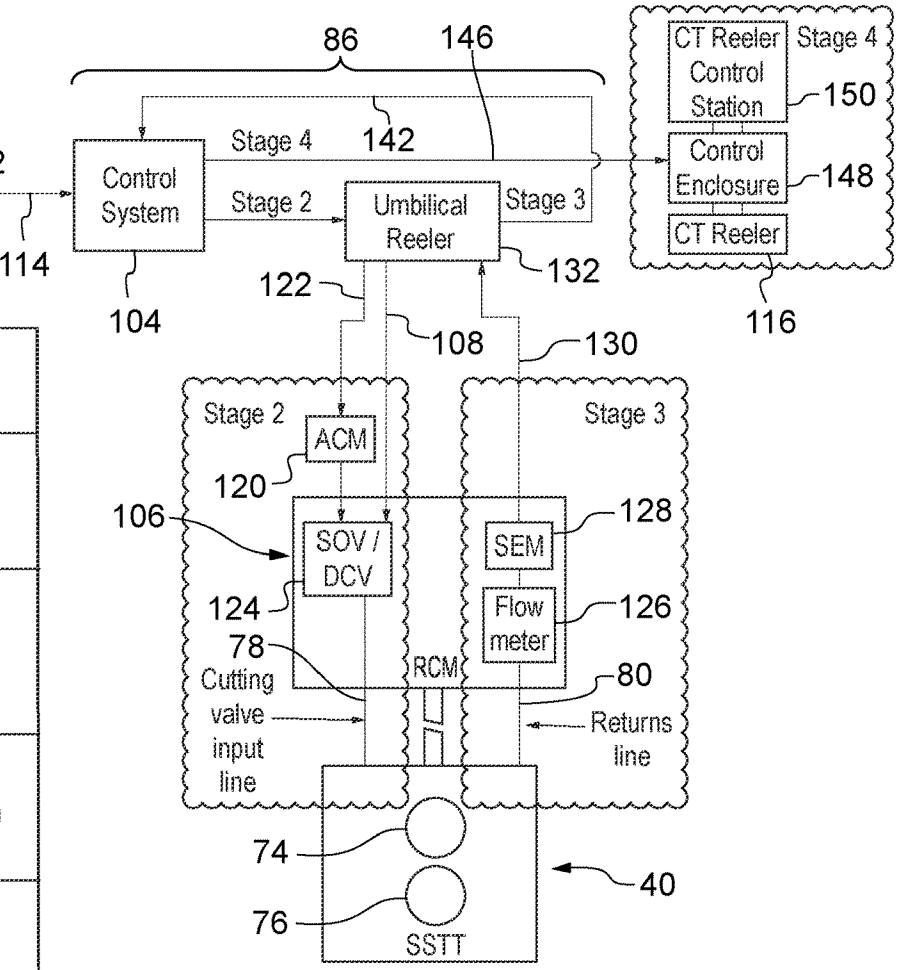
FIG. 4 is high level schematic view illustrating the SSTT and control system of FIG. 2.

FIG. 4 shows control lines 78 and 80, which are associated with the lower (cutting) SSTT valve 76. Separate control lines are also provided for the upper (sealing) SSTT valve 74, but are not shown in the drawing. Hydraulic fluid is supplied to the valve 76 via the control line 78, which forms an input line to actuate the valve from its open position to its closed position. Hydraulic fluid that is exhausted from the valve during its movement to the closed position exits the valve via the control line 80, which forms a return line. It will be understood that actuation of the valve 76 from its closed to its open position would involve the reverse flow of fluids through the lines 78 and 80.

The SSTT valves 74 and 76 can be of any suitable type, but are typically ball-type valves, comprising respective ball members 90 and 92 (shown in FIGS. 2 and 3), which are rotatable between open and closed positions. In the open position of the upper valve ball member 90, a bore 94 of the ball member is aligned with a bore 96 of the SSTT 40, whilst in a closed position, the bore 94 is disposed transverse to the SSTT bore 96, thereby sealing the bore. The lower SSTT ball member 92 similarly comprises a bore 100 which, in the open position, is aligned with the bore 96, and in the closed position is transverse to the bore, thereby cutting coiled tubing (or any other media) extending through the bore.

The control system 86 generally comprises a first control unit 104, and a second control unit 106. The first control unit 104 is configured to detect that the load in the TBRIS has reached a threshold, which is below a failure load of the weak link in the TBIRS. The second control unit 106 is connected to the SSTT 40, for triggering actuation of the SSTT to cause it to move from a deactivated state to an activated state in which it provides a well control function.

The threshold will typically be a proportion of the failure load of the weak link in the TBIRS. The threshold may be selected so that a safe operating margin is provided between the threshold being reached and the failure load being met or breached, so as to ensure actuation of the SSTT assembly 40. For example, the threshold may be a percentage of the failure load of the weak link in the TBIRS, and may be in the range of about 75% to about 95% of the failure load. There may be different failure loads in tension and compression, and so a tensile failure load and a compressive failure load. There may therefore be different thresholds in tension and compression, and so a tensile threshold and a compressive threshold.

The first control unit 104 is connected to the second control unit 106, and is configured to issue an activation command to the second control unit to cause it to trigger actuation of the SSTT 40. The first control unit 104 is configured to automatically issue the activation command to the second control unit 106 on detecting that the load in the TBIRS has reached the threshold. The activation command which is issued to the second control unit 106 by the first control unit 104 also causes the second control unit to actuate the RV 66, to thereby isolate the landing string contents.

The first and second control units 104 and 106 are configured so that the activation command is issued to the second control unit, to trigger actuation of the SSTT 40, prior to any structural failure of the TBIRS occurring (which would sever the control lines for the valves 74 and 76, preventing hydraulic actuation of the valves). In this way, actuation of the SSTT 40 can be ensured even in the event of a load being experienced by the TBIRS which leads to structural failure.

The first control unit 104 is a surface unit, which is typically provided at surface level, for example on the vessel 14 shown in FIG. 1. It is conceivable however that the first control unit 104 could be provided on or at seabed level. The second well control unit 106 is provided subsea, and in particular is provided in or as part of the TBIRS 10 shown in FIG. 1. This may provide the advantage that the second control unit 106 is positioned relatively close to the SSTT 40, so that it can rapidly actuate the SSTT on receipt of the activation command from the first control unit 104.

Whilst the second control unit 106 is typically provided as part of the TBIRS 10, and positioned above the BOP 42 as shown in the drawings, it is conceivable that the second control unit 106 could be provided within the BOP 42. This will ultimately depend, in the illustrated embodiment, upon the precise positioning of the SSTT 40 or other well control device whose function is controlled by the control system 86.

The first control unit 104 is connected to the second control unit 106 via a control line 108. In the illustrated embodiment, the control line 108 is an electrical control line, and the first control unit 104 is configured to issue an electrical activation command to the second control unit 106. This may provide the advantage that the activation command can be transmitted to the second control unit 106 relatively rapidly, on detection by the first control unit 104 that the load in the TBIRS has reached the threshold. It is expected that a delay of no more than perhaps 5 seconds may be experienced between detection that the load in the TBIRS has reached the threshold (by the first control unit 104), and actuation of the SSTT assembly 40.

The first control unit 104 can be arranged to issue the activation command to the second control unit 106, to cause the second control unit to actuate the SSTT 40, in two main situations.

In a first situation, the first control unit 104 is configured to issue the activation command on detecting a failure condition in the heave compensator or other device 17. A failure condition in the heave compensator 17 (such as a hydraulic failure leading to the compensator locking) results in an increase in the load in the TBIRS as the vessel 14 from which the TBIRS is deployed moves under prevailing sea or weather conditions, in particular during heave motion of the vessel. This will lead to the failure load of the weak link in the TBIRS being breached, a high tensile load being imparted on the string as the vessel 14 heaves upwardly relative to the wellhead, and a high compressive loading being imparted as the vessel heaves downwardly relative to the wellhead.

On detection that the loading in the weak link in the TBIRS has reached the threshold level (which is below the failure load in tension or compression), the first control unit 104 issues the activation command to the second control unit 106, via the control line 108. This in-turn causes the SSTT 40 to be triggered to actuate to move its valves 74 and 76 to their closed positions, controlled by the second control unit 106.

The SSTT 40 is typically operated so that the upper, sealing valve 74 is actuated with a time delay relative to the lower, cutting valve 76. In this way, the lower cutting valve 76 is provided with sufficient time to cut coiled tubing (or other media) extending though the bore 96 of the SSTT 40, and for the coiled tubing remaining in the SSTT bore above the lower valve 76 to be retrieved prior to actuation of the upper sealing valve 74 to its closed, sealing position.

A second situation in which the activation command is issued by the first control unit 104 to the second control unit 106 is one in which an over-tension/over-compression is applied to the TBIRS, leading to a load in the string approaching the failure load. This may occur when tensioning equipment coupled to the landing string 10, indicated generally by numeral 19 in FIG. 1, imparts a tension/compression which is above a planned or determined tensile load. This may occur as a result of operator failure, and/or a failure in the equipment 19. The tensioning equipment 19 is provided separately from the heave compensator or other device 17, and is used to apply a desired tension/compression to the landing string during deployment and operation, as is well known in the industry.

Other ways in which the activation command can be caused to issue include the vessel 14 moving off station through drive-off or drift-off, which can result in increased loading in the TBIRS that cannot be accommodated by the tensioning equipment 19.

The first control unit 104 cooperates with a load indicator 112 of the compensator 17 and/or the tensioning equipment 19, which indicates the loading in the TBIRS. The loading is measured by conventional means such as load sensors (not shown), which will be well known to persons skilled in the art and not described here. An interface, indicated schematically at 114 in FIG. 4, communicates the load data output by the load indicator 112 to the first control unit 104, which issues the activation command when the load in the TBIRS reaches the threshold. It will be understood that the first control unit 104, second control unit 106, and the load indicator 112 will all include suitable computer processors and/or data storage media, operating suitable software, which enables their operation as described above.

The first control unit 104 can also be configured to operate a reeling device 116, to retract coiled tubing (or other media) extending through the bore 96 of the SSTT 40. FIG. 1 shows a coiled tubing 118 deployed from the vessel 14 through the landing string 10, RV 26 and SSTT 24 and into the wellbore of the well. As is well known in the industry, coiled tubing provides an efficient means of deploying equipment into a well, and is used in many scenarios. The coiled tubing is wound on to a reel (not shown) on the vessel 14, and deployed from the reel down through the TBIRS 10 when required. In a similar fashion, wireline or slickline (not shown) may be employed to deploy a tool into a well, at least in wells which are substantially vertical. Wireline and slickline is also deployed from a reel using suitable equipment.

In the specific context of the SSTT 40 shown in FIGS. 2 and 3, in which the lower valve 76 provides a cutting function and the upper valve 74 a sealing function, operation of the SSTT 40 presents a risk of the bore 94 of the upper sealing valve being blocked by the coiled tubing, or indeed any other media which has been deployed through the SSTT, and which is present in the bore 96 when the SSTT is actuated to close the valves 74 and 76. Whilst the lower, cutting valve 76 can sever and so cut coiled tubing (or other media), the portion of coiled tubing located above the lower cutting valve 76 will block the bore 94 of the upper sealing valve 74, preventing it from moving from its open position of FIG. 2 to its closed position of FIG. 3. The first control unit 104 can therefore be configured to operate the reeling device 116 so as to retract the portion of coiled tubing above the cut from the SSTT 40, so as to clear the bore 94 of the upper sealing valve 74, and ideally a bore of the RV 66. This ensures correct operation of the sealing valve 74 to seal the bore 96 of the SSTT 40, and provides well control.

The first control unit 104 is configured to trigger the reeling device 116 to actuate under specified conditions. Firstly, the first control unit 104 must have detected that the load in the TBIRS has reached the threshold. Secondly, the first control unit 104 is programmed to recognize that the coiled tubing (or other media) is located in the bore 96 of the SSTT 40. This can be achieved in numerous ways, including by communication between the first control unit 104 and the reeling device 116, and/or by suitable sensors provided in the SSTT 40. Thirdly, the first control unit 104 is programmed to recognize that actuation of the SSTT 40 would restrict at least one function of the SSTT (e.g. correct operation and so closure of the upper sealing valve 74), and initiates the reeling device 116 after a specified time period has passed.

The first control unit 104 will be programmed with information relating to the type of SSTT 40 which has been deployed, and so will recognize that actuation of the lower cutting valve 76 presents a risk of the bore 94 of the upper sealing valve 74 being blocked when the SSTT 40 is actuated. Issue of the activation command from the first control unit 104 to the second control unit 106, to trigger actuation of the SSTT 40, can also actuate the first control unit 104 to operate the reeling device 116. Operation of the reeling device 116 is scheduled, by the first control unit 104, so that the reeling device only operates to withdraw the coiled tubing (or other media) following correct operation of the lower cutting valve 76 to move to its fully closed position of FIG. 3, in which it shears the coiled tubing. The upper sealing valve 74 is scheduled to operate with a time-delay relative to operation of the lower cutting valve 76. This provides time for withdrawal of the coiled tubing following the cutting process.

The second control unit 106 also comprises a source of energy for actuating the SSTT 40. In the illustrated embodiment, the second control unit 106 comprises a source of hydraulic energy in the form of a subsea accumulator 120. The accumulator 120 comprises a volume of pressurized fluid, and is typically charged with the fluid prior to deployment of the TBIRS 10 from surface. In addition, the accumulator 120 can be supplied with hydraulic fluid via a hydraulic control line 122 extending to surface and connected to the first control unit 104. Whilst reference is made to a hydraulic energy source, it will be understood that other types of energy source may be provided, including a source of electrical energy such as a battery and/or an electrical power conduit extending to surface.

The second control unit 106 also comprises a valve 124 which is operable to control the flow of hydraulic fluid from the accumulator 120 to the SSTT 40 to operate the valves 74 and 76. As discussed above, FIG. 4 shows a cutting valve input line 78 which is supplied with hydraulic fluid from the accumulator 120 under the control of the valve 124. The valve 124 is typically a solenoid operated valve (SOV) and/or a directional control valve (DCV), which can be selectively actuated to allow pressurized hydraulic fluid to be supplied through the control line 78 to the lower cutting valve 76, to actuate the valve from its open position of FIG. 2 to its closed position of FIG. 3.

The second control unit also comprises a flow monitoring device, in the form of a flow meter 126, which is also coupled to the SSTT 40, in this case to the lower cutting valve 76, via the hydraulic return line 80. As will be understood by persons skilled in the art, the hydraulically actuated cutting valve 76 is actuated to move from its open position by the supply of hydraulic fluid along the cutting valve input line 78, with fluid exhausted from an actuating cylinder of the valve (not shown) along the return line 80. The flow meter 126 monitors the flow of fluid exhausted from the cutting valve 76, and determines a corresponding actuation state of the valve. In the illustrated embodiment, the flow meter 126 serves for monitoring the flow of fluid exhausted from the cutting valve 76 during movement from its open to its closed position.

The flow meter 126 is capable of determining the actuation state of the cutting valve 76 by measuring the volume of fluid exiting the valve. Actuation of the cutting valve 76 to its fully closed position requires that a determined volume of fluid exit the valve actuating cylinder. The flow meter 126 can therefore determine that the cutting valve 76 has been fully closed when the determined volume of fluid is detected as having exited the valve. This enables a determination to be made that the cutting valve 76 has moved to its fully closed position of FIG. 3, therefore severing the coiled tubing (or other media) extending through the bore 96 of the SSTT 40.

The second control unit 106 also comprises a subsea electronics module (SEM) 128, which can transmit information relating to the activation state of the cutting valve 76, determined using the flow meter 126, to the first control unit 104 at the surface via an electrical control line 130. The first control unit 104 is configured to employ the information relating to the activation state of the cutting valve 76 to determine whether to actuate the reeling device 116.

The first control unit 104 may be configured to trigger the reeling device 116 to actuate only when a further condition is satisfied, in which the cutting valve 76 is detected as having moved to its fully closed position of FIG. 3. This ensures that the reeling device 116 is not operated until such time as a determination has been made that the coiled tubing (or other media) extending through the bore 96 of the SSTT 40 has been cut. Operation of the reeling device 116 is therefore sequenced so that the coiled tubing is withdrawn from the bore 94 of the upper sealing valve 74 only after cutting of the coiled tubing has been effected by the lower cutting valve 76.

Operation of the valve 124 to supply hydraulic fluid to the cutting valve 76 through the input line 78 is controlled by the activation command issued from the first control unit 104 to the second control unit 106 via the electrical control line 108.

In the illustrated embodiment, the second control unit 106, comprising the valve 124, flow meter 126 and SEM 128, is provided as a unit in a riser control module (RCM), which is deployed subsea using the TBIRS 10, and which is connected to the SSTT 40. The umbilical reeler 132 is retracted with the landing string 56 when disconnected, the control system being connected to the umbilical reeler such that appropriate control signals can be sent.

Figure 5:
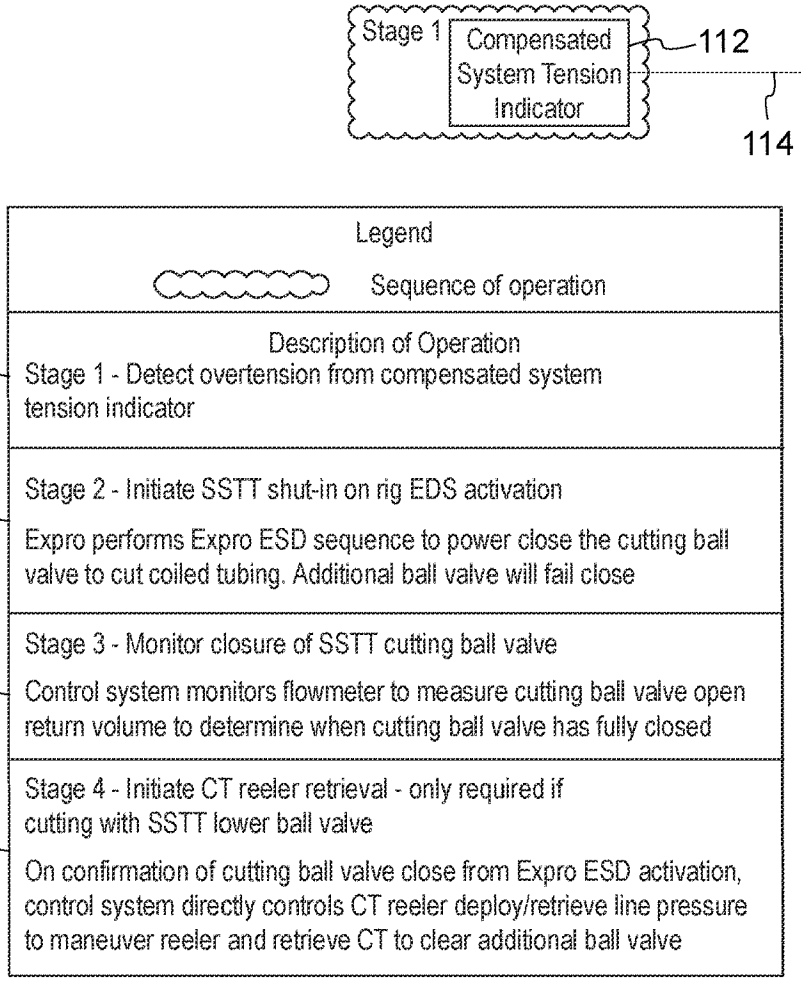
FIG. 5 is a flow chart illustrating stages in an operation sequence of a well control arrangement comprising the SSTT and the control system of FIGS. 2 to 4.

FIG. 5 is a flow chart illustrating stages in the operation of the control system 86, and of the well control assembly comprising the SSTT 40 and the control system.

A first stage is indicated in box 136, in which the load in the TBIRS has reached the determined threshold. As discussed above, the first control unit 104 cooperates with the load indicator 112 via the interface 114, so that data relating to the loading in the landing string is communicated to the first control unit.

A second stage is indicated by box 138, in which the first control unit 104, having detected that the load in the TBIRS has reached the threshold, issues the activation command to the second control unit 106, located subsea. The activation command is transmitted via the electrical control line 108 to operate the valve 124 and supply pressurized hydraulic fluid to the lower cutting valve 76, via the hydraulic cutting line 78. Hydraulic fluid may also be supplied to actuate the upper sealing valve 74, although as is well known, the sealing valve may be biased, for example by a spring (not shown), to automatically move to its closed position of FIG. 3 (and so to "fail close").

A third stage is indicated by box 140, in which the flow meter 126 monitors the return flow of fluid exiting the cutting valve 76, via the hydraulic return line 80, to determine when the cutting valve 76 has moved to its fully closed position of FIG. 3. The data relating to the actuation state of the cutting valve 76 is transmitted from the second control unit 106 to the first control unit 104 under the control of the SEM 128, and via the electrical control line 130. When a determination is made that the cutting valve 76 has fully closed, this information is fed to the first control unit 104, as indicated by the arrow 142 in FIG. 4.

On detection that the cutting valve 76 has fully closed, a fourth stage is entered, as indicated by the box 144 in FIG. 5. In this stage, and taking account of the factors discussed above in terms of the presence of coiled tubing (or other media) in the bore 96 of the SSTT 40, the first control unit 104 triggers initiation of the reeling device 116, to retrieve the coiled tubing and so retract it from the bore 94 of the upper sealing valve 74, as indicated by the arrow 146 in FIG. 4. The trigger command for the reeling device 116 is relayed to a control enclosure 148. Operation of the reeling device 116 is controlled from a control station 150 associated with the control enclosure 148, which can cause the reeling device 116 to be triggered into operation. Operation of the reeling device 116 may require operator input, or may be automatic. On activation of the reeling device 116, appropriate hydraulic control of deploy and retrieve line pressure in a hydraulic control system (not shown) for the reeler 116 is provided, to maneuver the reeler and retrieve the coiled tubing, to clear the upper sealing valve bore 94 and RV 66 if required.

The control system 86 of the present disclosure, and the well control arrangement comprising the SSTT 40 and the control system, enables actuation of the SSTT prior to structural failure of the weak link in the TBIRS. This ensures that the SSTT valves 74 and 76 can be actuated to move from their open positions to their closed positions prior to control equipment associated with the SSTT 40 being severed (the electrical control lines 108 and 130, and the hydraulic control line 122 provided in the umbilical). The well can therefore be safely contained without requiring operation of the BOP 42.

Various modifications may be made to the foregoing without departing from the spirit or scope of the present invention.

For example, other means of connecting the first control unit to the second control unit may be employed, including but not restricted to electromagnetic signaling equipment comprising a transmitter associated with the first control unit and a receiver associated with the second control unit, which may be adapted to transmit and receive radio frequency or ultrasonic frequency signals, respectively. The landing string coupled to the second control unit may act as a signal transmission medium.

The present disclosure describes in detail the operation of the invention in a TBIRS, however it should be noted that the invention has applicability to other IRS types for example an OWIRS. Whilst described in detail in the particular context of operating a well control device in the form of an SSTT, it will be understood however that the control system and operating principles described in this document may be applied to other types of well control devices, including other types of valves and valve assemblies, and SSTTs which are configured differently to that described above. Particular alternative valves may have only a single valve element, and/or can comprise a valve having a cutting and sealing function. Alternative SSTTs may have cutting and sealing valves which are arranged differently to that described above (e.g. with a cutting valve located above a sealing valve), and/or can comprise one or more valve which has a cutting and sealing function.

The invention claimed is:

1. A control system for automatically operating a subsea well control device on detecting that a load in an Intervention Riser System (IRS) coupled to the subsea well control device has reached a threshold, wherein the threshold is below a failure load of the IRS, the control system comprising:

a first control unit configured to detect that the load in the IRS has reached the threshold; and a second control unit adapted to be connected to the subsea well control device, for triggering actuation of the subsea well control device to cause the subsea well control device to move from a deactivated state to an activated state in which the subsea well control device provides a well control function;

in which the first control unit is connected to and/or in communication with the second control unit and configured to issue an activation command to the second control unit to cause the second control unit to trigger actuation of the subsea well control device; and in which the first control unit is configured to automatically issue the activation command to the second control unit upon detecting that the load in the IRS has reached the threshold, to trigger actuation of the subsea well control device prior to structural failure of the IRS or a component thereof occurring;

wherein the subsea well control device is a valve assembly that includes a cutting valve and a sealing valve, and the sealing valve is disposed uphole of the cutting valve; and wherein prior to actuation of the subsea well control device a media extends through a bore of the well control device and is in communication with the cutting valve and the sealing valve; and wherein the actuation of the subsea well control device includes actuating the cutting valve before actuating the sealing valve; and wherein the cutting valve actuation is configured to cause the media to be cut while the media is in communication with the sealing valve; and wherein the actuation of the subsea well control device includes automatically withdrawing the media from communication with the sealing valve after the cutting valve actuation and actuating the sealing valve after the media is withdrawn from communication with the sealing valve.

2. The control system of claim 1, in which:

i) the control system is for automatically operating the well control device on detecting a failure condition in a heave compensator or other device; and/or, ii) the control system is for automatically operating the well control device on detecting an overload in the IRS imparted by tensioning equipment; and/or, iii) the threshold is a proportion of the failure load of a predetermined, estimated, or a pre-identified weak link in the IRS; and/or, iv) the first control unit is adapted to be provided at a sea surface, and the second control unit is adapted to be provided at a subsea location; and/or, v) the second control unit is adapted to be provided as part of the IRS, and in which the IRS is deployable at the subsea location.

3. The control system of claim 1, in which the first control unit is connected to the second control unit via at least one control line, and is configured to issue an electrical activation command to the second control unit.

4. The control system of claim 1, in which the first control unit is configured to operate a reeling device to withdraw the media extending through the bore of the well control device.

5. The control system of claim 1, in which the second control unit comprises a source of hydraulic energy for actuating the well control device wherein the second control unit comprises at least one valve for controlling the flow of hydraulic fluid from the source of hydraulic energy to the well control device.

6. The control system of claim 5, in which the second control unit comprises a flow monitoring device adapted to be coupled to at least one valve of the well control device, the flow monitoring device configured to monitor the flow of fluid from the control device valve and determine a corresponding actuation state of the control device valve.

7. The control system of claim 1, in which the second control unit is provided as part of a riser control module (RCM) adapted to be coupled to the well control device and provided in a landing string coupled to the well control device, for deploying the device into the well.

8. A well control arrangement comprising a subsea well control device and a control system for automatically operating the subsea well control device on detecting that a load in an Invention Riser System (IRS) coupled to the subsea well control device has reached a threshold, wherein the threshold is below a failure load of the IRS, the control system comprising:

a first control unit configured to detect that the load in the IRS has reached the threshold; and a second control unit connected to the subsea well control device, for triggering actuation of the subsea well control device to cause the subsea well control device to move from a deactivated state to an activated state in which the subsea well control device provides a well control function;

in which the first control unit is connected to and/or in communication with the second control unit and configured to issue an activation command to the second control unit to cause it the second control unit to trigger actuation of the subsea well control device;

and in which the first control unit is configured to automatically issue the activation command to the second control unit upon detecting that the load in the IRS has reached the threshold, to trigger actuation of the subsea well control device prior to any structural failure of the IRS equipment occurring;

wherein the subsea well control device is a valve assembly that includes a cutting valve and a sealing valve, and the sealing valve is disposed uphole of the cutting valve; and wherein prior to actuation of the subsea well control device, a media extends through a bore of the well control device and is in communication with the cutting valve and the sealing valve; and wherein the actuation of the subsea well control device includes actuating the cutting valve before actuating the sealing valve; and wherein the cutting valve actuation is configured to cause the media to be cut while the media is in communication with the sealing valve; and wherein the actuation of the subsea well control device includes automatically withdrawing the media from communication with the sealing valve after the cutting valve actuation and actuating the sealing valve after the media is withdrawn from communication with the sealing valve.

9. The well control arrangement of claim 8, in which the IRS is a through-BOP intervention riser system (TBIRS) carrying the subsea well control device, for deploying the device subsea, the second well control unit provided in the TBIRS.

10. The well control arrangement of claim 8, in which the control system is for automatically operating the well control device on detecting an overload in the media imparted by a tensioning equipment coupled to the IRS.

11. The well control arrangement of claim 8, in which the subsea well control device is a subsea test tree (SSTT).

12. A well control assembly for a subsea well, comprising:

an Invention Riser System (IRS) comprising a subsea well control device and a string of tubing coupled to the subsea well control device, for deploying the subsea well control device from a surface facility to a subsea location;

a tensioning device, for controlling an amount of tension applied to the string of tubing; and a control system for automatically operating the subsea well control device on detecting that a load in the tubing coupled to the subsea well control device has reached a threshold, wherein the threshold is below a predetermined, estimated or a pre-defined failure load of a weak link in the IRS, the control system comprising:

a first control unit configured to detect that the load in the IRS has reached the threshold; and a second control unit connected to the subsea well control device, for triggering actuation of the subsea well control device to cause the subsea well control device to move from a deactivated state to an activated state in which the subsea well control device provides a well control function;

in which the first control unit is connected to the second control unit and configured to issue an activation command to the second control unit to cause the second control unit to trigger actuation of the subsea well control device;

and in which the first control unit is configured to automatically issue the activation command to the second control unit on detecting that the load in the IRS has reached the threshold, to trigger actuation of the subsea well control device prior to any structural failure of the IRS equipment occurring;

wherein the subsea well control device is a valve assembly that includes a cutting valve and a sealing valve, and the sealing valve is disposed uphole of the cutting valve; and wherein prior to actuation of the subsea well control device, the tubing extends through a bore of the well control device and is in communication with the cutting valve and the sealing valve; and wherein the actuation of the subsea well control device includes actuating the cutting valve before actuating the sealing valve; and wherein the cutting valve actuation is configured to cause the tubing to be cut while the tubing is in communication with the sealing valve; and wherein the actuation of the subsea well control device includes automatically withdrawing the tubing from communication with the sealing valve after the cutting valve actuation and actuating the sealing valve after the tubing is withdrawn from communication with the sealing valve.

13. A method of operating a well control assembly comprising a subsea well control device, the method comprising:

detecting a load in an Invention Riser System (IRS) coupled to the subsea well control device using a first control device;

using the first control unit to automatically issue an activation command to a second control unit, the second command unit in communication with the subsea well control device and configured to control actuation of the subsea well control device;

wherein upon the first control unit detecting that the load in the IRS has reached a threshold which is below a failure load of a weak link in the IRS, using the first control device to cause the second control unit to trigger actuation of the subsea well control device to move from a deactivated state to an activated state in which the subsea well control device provides a well control function, so that the subsea well control device is actuated prior to any structural failure of the IRS equipment occurring;

wherein the subsea well control device is a valve assembly that includes a cutting valve and a sealing valve, and the sealing valve is disposed uphole of the cutting valve; and wherein prior to actuation of the subsea well control device, the tubing extends through a bore of the well control device and is in communication with the cutting valve and the sealing valve; and wherein the actuation of the subsea well control device includes actuating the cutting valve before actuating the sealing valve; and wherein the cutting valve actuation is configured to cause the tubing to be cut while the tubing is in communication with the sealing valve; and wherein the actuation of the subsea well control device includes automatically withdrawing the tubing from communication with the sealing valve after the cutting valve actuation and actuating the sealing valve after the tubing is withdrawn from communication with the sealing valve.

* * * * *